US007013666B2

(12) United States Patent
Park et al.

(10) Patent No.: US 7,013,666 B2
(45) **Date of Patent: *Mar. 21, 2006**

(54) MULTI-AIR CONDITIONER AND OPERATION METHOD THEREOF

(75) Inventors: Jong Han Park, Gwangmyeong-si (KR); Young Min Park, Incheon-si (KR); Chang Seon Lee, Seoul (KR); Sung Oh Choi, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 235 days.

This patent is subject to a terminal disclaimer.

(21) Appl. No.: 10/643,912

(22) Filed: Aug. 20, 2003

(65) Prior Publication Data

US 2004/0035135 A1 Feb. 26, 2004

(30) Foreign Application Priority Data

Aug. 24, 2002 (KR) ..... 10-2002-0050319

(51) Int. Cl.
*F25B 41/04* (2006.01)
*F25B 13/00* (2006.01)

(52) U.S. Cl. ..... 62/324.6; 62/324.1; 62/223

(58) Field of Classification Search ..... 62/324.6, 62/324.1, 160, 278, 197, 504, 510, 335, 498, 62/513

See application file for complete search history.

(56) References Cited

U.S. PATENT DOCUMENTS 5,297,392 A * 3/1994 Takata et al. ..... 62/160
5,309,733 A * 5/1994 Hayashida et al. ..... 62/278
5,388,422 A 2/1995 Hayashida et al.
5,996,368 A 12/1999 Kim
6,125,640 A 10/2000 Kim

FOREIGN PATENT DOCUMENTS

EP 0575063 12/1993
JP 11083223 A * 3/1999

* cited by examiner

*Primary Examiner*—Chen Wen Jiang
(74) *Attorney, Agent, or Firm*—Greenblum & Bernstein, P.L.C.

(57) ABSTRACT

Disclosed is a multi-air conditioner in which heating and cooling operations are performed at the same time, the number of connection pipes connecting outdoor unit and distributor is simplified to three to flow a specific pressure and phase refrigerant through each connection pipe regardless of operation condition. The air conditioner includes: an outdoor unit installed at an outdoor location, and having therein a compressor and an outdoor heat exchanger; a plurality of indoor units respectively installed at indoor rooms, each of the indoor units having therein an electronic expansion valve and an indoor heat exchanger; a distributor provided between the outdoor unit and the plurality of indoor units, for selectively guiding a refrigerant introduced from the outdoor unit to the plurality of indoor units according to an operation condition; a four-way valve provided on an outlet side of the compressor, for selectively switching a flow direction of the refrigerant flowing through the outdoor heat exchanger; a first connection pipe branched from a pipe connecting an inlet side of the compressor with the four-way valve, for connecting the distributor to guide the refrigerant; a second connection pipe for connecting the outdoor heat exchanger with the distributor to guide the refrigerant; and a selective expansion apparatus provided on the third connection pipe and including a heating electronic expansion unit for selectively expanding the refrigerant.

20 Claims, 7 Drawing Sheets

MULTI-AIR CONDITIONER AND OPERATION METHOD THEREOF

This application claims the benefit of the Korean Application No. P2002-0050319 filed on Aug. 24, 2002, which is hereby incorporated by reference.

BACKGROUND OF THE INVENTION

1. Field of the Invention

The present invention relates to a multi-air conditioner, and more particularly, to a multi-air conditioner and an operation method thereof capable of simultaneously performing cooling and heating operation.

2. Discussion of the Related Art

Generally, an air conditioner is an apparatus for cooling or heating an indoor space such as a residential space, office, restaurant and the like. Recently, a multi-air conditioner has been developed so as to more effectively cool or heat an inner space partitioned into a plurality of rooms.

The multi-air conditioner is comprised of one outdoor unit, and a plurality of indoor units each being connected to the outdoor unit and being installed every room. The multi-air conditioner operates in one of heating mode and cooling mode, thereby heating or cooling the room air.

However, the conventional multi-air conditioner has a drawback in that even when some rooms among the partitioned rooms need to be heated while other rooms need to be cooled, since all the indoor units are operated in heating mode or cooling mode, the conventional multi-air conditioner does not meet the request of the aforementioned multi-operations.

For example, in buildings, there may occur a temperature difference according to a directional position and a daylight time. That is, the northern rooms of a building need to be heated while the southern rooms need to be cooled owing to the sunlight. However, the conventional air conditioners have a limitation in meeting such requirements. Further, in case a building has a computer center, the building always needs to be cooled even in summer days as well as in winter days, so as to solve heat load generated from the computer equipments. However, the conventional air conditioner does not yet meet such selective air-conditioning requirements.

In order to solve these disadvantages, the multi-air conditioner is required to condition each room air individually at the same time. That is, it is requested that some room airs be heated in the heating mode and at the same time, other room airs be cooled in the cooling mode. Accordingly, it is required to develop a multi-air conditioner capable of selectively and simultaneously performing cooling and heating and having an economical structure for installation.

SUMMARY OF THE INVENTION

Accordingly, the present invention is directed to a multi-air conditioner and an operation method thereof that substantially obviate one or more problems due to limitations and disadvantages of the related art.

An object of the present invention is to provide a multi-air conditioner capable of simultaneously performing cooling and heating operations.

Another object of the present invention is to provide a multi-air conditioner in which a pipe connecting an outdoor unit and a distributor is simplified and thereby the pipe structure of the distributor is simplified to enhance the efficiency of the air conditioner.

A further another object of the present invention is to provide a multi-air conditioner and an operation method thereof in which the number of the distributors is varied depending on the number, position, distance or the like of rooms to thereby make the installation of the respective indoor units easy, and the plurality of distributors are connected without separate means.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a multi-air conditioner including: an outdoor unit installed at an outdoor location, and having therein a compressor and an outdoor heat exchanger; a plurality of indoor units respectively installed at indoor rooms, each of the indoor units having therein an electronic expansion valve and an indoor heat exchanger; a distributor provided between the outdoor unit and the plurality of indoor units, for selectively guiding a refrigerant introduced from the outdoor unit to the plurality of indoor units according to an operation condition; a four-way valve provided on a discharge side of the compressor, for selectively switching a flow direction of the refrigerant flowing through the outdoor heat exchanger; a first connection pipe branched from a pipe connecting an absorbing side of the compressor with the four-way valve, for connecting the distributor to guide the refrigerant; a second connection pipe branched from a pipe connecting the discharge side of the compressor with the four-way valve, for connecting the distributor to guide the refrigerant; a third connection pipe for connecting the outdoor heat exchanger with the distributor to guide the refrigerant; and a selective expansion apparatus provided on the third connection pipe and including a heating electronic expansion unit for selectively expanding the refrigerant.

Here, the four-way valve comprises three outlets respectively connected with the discharge outlet/the absorbing inlet of the compressor, and the outdoor heat exchanger, and one outlet, which is closed. Also, the four-way valve selectively switches between a first connection state in which the discharge outlet of the compressor is connected with the outdoor heat exchanger and the absorbing inlet of the compressor is connected with the closed outlet of the four-way valve, and a second connection state in which the discharge outlet of the compressor is connected with the closed inlet of the four-way valve and the absorbing inlet of the compressor is connected with the outdoor heat exchanger.

The selective expansion apparatus comprises: a check valve for passing the refrigerant flowing out of the outdoor heat exchanger and cutting-off the refrigerant introduced into the outdoor heat exchanger; a parallel pipe respectively branched from a front end and a rear end of the check valve and provided in parallel with the check valve; and a first electronic expansion valve provided on the parallel pipe.

The refrigerant flowing through the first connection pipe is maintained in a state of a low pressure/vapor phase, the refrigerant flowing through the second connection pipe is maintained in a state of a high pressure/vapor phase, and the refrigerant flowing through the third connection pipe is maintained in a state of a high pressure/liquid phase.

The compressor comprises a plurality of compressors connected in parallel with each other, for performing compression operation. The absorbing inlet of the compressor further comprises an accumulator.

The distributor comprises: a guide pipe part for guiding the refrigerant introduced from the outdoor unit to the respective indoor units through the second connection pipe or the third connection pipe, and guiding the refrigerant heat-exchanged in the respective indoor units to the outdoor unit through the first connection pipe or the third connection pipe; and a valve part for controlling a flow of the refrigerant in the guide pipe part such that the refrigerant is selectively introduced into the respective indoor unit according to the operation condition.

The guide pipe part comprises: a first vapor pipe connected with the first connection pipe, for guiding the low pressure/vapor-phase refrigerant; first vapor divergent pipes branched from the first vapor pipe and connected to the respective indoor units; a second vapor pipe connected with the second connection pipe, for guiding the high pressure/vapor-phase refrigerant; second vapor divergent pipes branched from the second vapor pipe and connected to the respective indoor units; a by-pass pipe connecting the second connection pipe with the first vapor pipe; a liquid pipe connected with the third connection pipe, for guiding the high pressure/liquid-phase refrigerant; and liquid divergent pipes branched from the liquid pipe and connected to the respective indoor units.

The valve part comprises: a second electronic expansion valve for preventing the refrigerant supplied into the by-pass pipe from being liquefied; and a two-way valve provided on each of the first vapor divergent pipes and the second vapor divergent pipes, and turned on or off according to the operation condition.

The electronic expansion valve provided on each of the indoor units is provided on the liquid divergent pipe.

Preferably, the distributor comprises a plurality of distributors provided for easy installation of each of the indoor units. In this case, the first vapor pipe of each of the distributors is connected with the first connection pipe of the outdoor unit, the second vapor pipe of each of the distributors is connected with the second connection pipe of the outdoor unit, and the liquid pipe of each of the distributors is connected with the third connection pipe.

In case the indoor units all operate in the cooling mode or in case the majority of indoor units operate in the cooling mode while the rest operate in the heating mode, the four-way valve is switched to connect the outlet of the compressor with the outdoor heat exchanger and to connect the inlet of the compressor with the closed inlet of the four-way valve.

In case the indoor units all operate in the cooling mode, the first electronic expansion valve is closed and the second electronic expansion valve is operated, the electronic expansion valves connected with all the indoor units is operated, the two-way valves provided on the first vapor divergent pipe are all closed, and the two-way valves provided on the second vapor divergent pipe are all closed. Also, in case the majority of indoor units operate in the cooling mode while the rest operates in the heating mode, the first and second electronic expansion valves are closed, in case of the indoor units operating in the cooling mode, the electronic expansion valves connected to the indoor heat exchangers are operated, the two-way valves provided on the first vapor divergent pipes are opened, and the two-way valves provided on the second vapor divergent pipes are closed, and in case of the indoor units operating in the heating mode, the electronic expansion valves connected to the indoor heat exchangers are opened, and the two-way valves provided on the first vapor divergent pipes are closed, and the two-way valves provided on the second vapor divergent pipes are opened.

In the meanwhile, in case the indoor units all operate in the heating mode, or in case the majority of indoor units operate in the heating mode while the rest operates in the cooling mode, the four-way valves are switched to connect the outlet of the compressor with the closed inlet of the four-way valve and to connect the inlet of the compressor with the outdoor heat exchanger.

Herein, in case the indoor units all operate in the heating mode, the first electronic expansion valve is operated, the second electronic expansion valve is closed, the electronic expansion valves connected with all the indoor units are opened, the two-way valves provided on the first vapor divergent pipe are all closed, and the two-way valves provided on the second vapor divergent pipe are all opened. Also, in case the majority of indoor units operate in the heating mode while the rest operates in the cooling mode, the first electronic expansion valve is operated and the second electronic expansion valve is closed, in case of the indoor units operating in the heating mode, the electronic expansion valves connected to the indoor heat exchangers are opened, the two-way valves provided on the first vapor divergent pipes are closed, and the two-way valves provided on the second vapor divergent pipes are opened, and in case of the indoor units operating in the cooling mode, the electronic expansion valves connected to the indoor heat exchangers are operated, the two-way valves provided on the first vapor divergent pipes are opened, and the two-way valves provided on the second vapor divergent pipes are closed.

In another aspect of the invention, there is provided an operation method of a multi-air conditioner. The method comprises the steps of: in case indoor units all operate in a cooling mode, or in case a majority of indoor units operate in the cooling mode while the rest operate in a heating mode, switching a four-way valve such that a refrigerant discharged from a compressor passes through an outdoor heat exchanger; and closing a first electronic expansion valve provided on a selective expansion apparatus to guide the refrigerant condensed in the outdoor heat exchanger to a distributor, and in case the indoor units all operate in the heating mode, or in case the majority of indoor units operate in the heating mode while the rest operate in the cooling mode, switching the four-way valve such that refrigerant discharged from the compressor is introduced into the distributor; and operating the first electronic expansion valve provided on the selective expansion apparatus to expand the refrigerant introduced into the outdoor heat exchanger from the distributor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
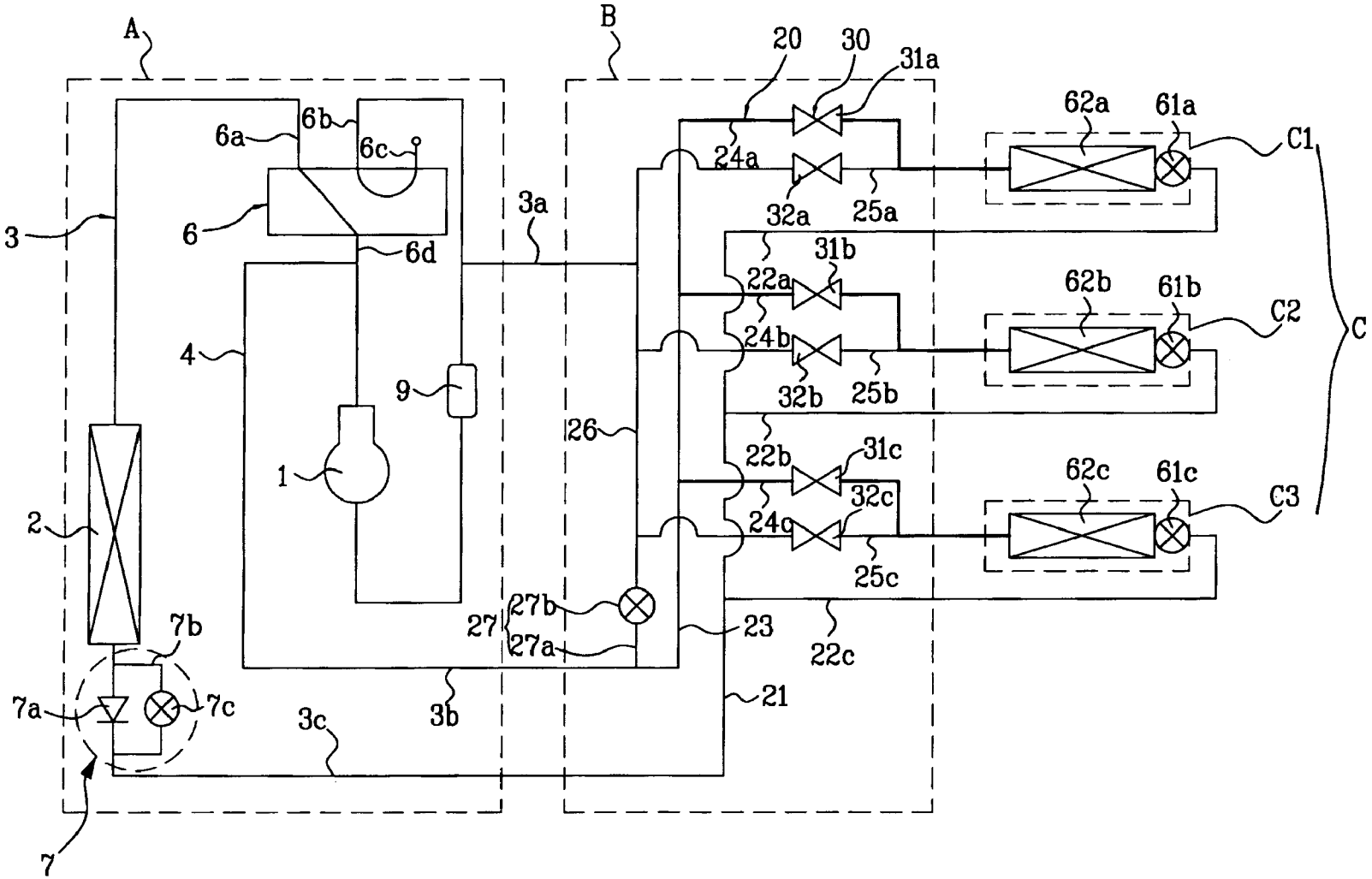
FIG. 1 is a construction view of a multi-air conditioner according to a preferred embodiment of the present invention.

FIG. 1 is a construction view of illustrating structural elements of a multi-air conditioner according to a preferred embodiment of the present invention.

Herein, it is noted that a reference numeral 22 indicates "22*a*, 22*b* and 22*c*", 24 indicates "24*a*, 24*b* and 24*c*", 25 indicates "25*a*, 25*b* and 25*c*", 31 indicates "31*a*, 31*b* and 31*c*", 61 indicates "61*a*, 61*b* and 61*c*", and 62 indicates "62*a*, 62*b* and 62*c*", for description convenience. However, it will be understood that the numbers of the reference numerals can be changed depending on the numbers of indoor units (C).

The multi-air conditioner includes an outdoor unit (A), a distributor (B), and a plurality of indoor units (C1, C2 and C3).

Hereinafter, preferred embodiments for the outdoor unit (A), the distributor (B) and the plurality of indoor units (C) will be described according to the order named.

As pipes of the outdoor unit (A) are configured to be simple, pipe loss is decreased and unit efficiency is enhanced. Accordingly, among the respective pipes of the outdoor unit (A), pipes 3*a*, 3*b* and 3*c* connected with the distributor (B) are preferably designed to flow a specific pressure and phase of refrigerant therethrough regardless of an operation condition. This is to prevent non-uniformity of the flow between a refrigerant having a low pressure and a high specific volume and a refrigerant having a high pressure and a low specific volume and to maintain the diameter of the pipes at a fixed single size. Further, the pipe construction of the distributor (B) is simplified by no needing the pipe construction of the distributor (B) to be changed according to the operation condition.

As shown in FIG. 1, the outdoor unit (A) includes a compressor 1, an outdoor heat exchanger 2, three connection pipes 3*a*, 3*b* and 3*c*, a four-way valve 6 and a selective expansion apparatus 7.

The four-way valve 6 is provided to change the flow direction of the refrigerant flowing through the outer heat exchanger 2. The three connection pipes 3*a*, 3*b* and 3*c* connect the outer unit (A) and the distributor (B).

Here, the first connection pipe 3*a* is branched from a pipe connecting an inlet side of the compressor 1 and the four-way valve, and is connected with the distributor (B). The second connection pipe 3*b* is branched from a pipe connecting an outlet side of the compressor 1 and the four-way valve 6 and is connected with the distributor (B). The third connection pipe 3*c* connects the outer heat exchanger 2 and the distributor (B).

In case the operation condition is changed, the four-way valve 6 is switched to change the flow direction of the refrigerant flowing through the outer heat exchanger 2. When the four-way valve 6 is switched, the flow direction of the refrigerant is not changed in the first and second connection pipes 3*a* and 3*b* but is changed in the third connection pipe 3*c*.

Figure 4A:
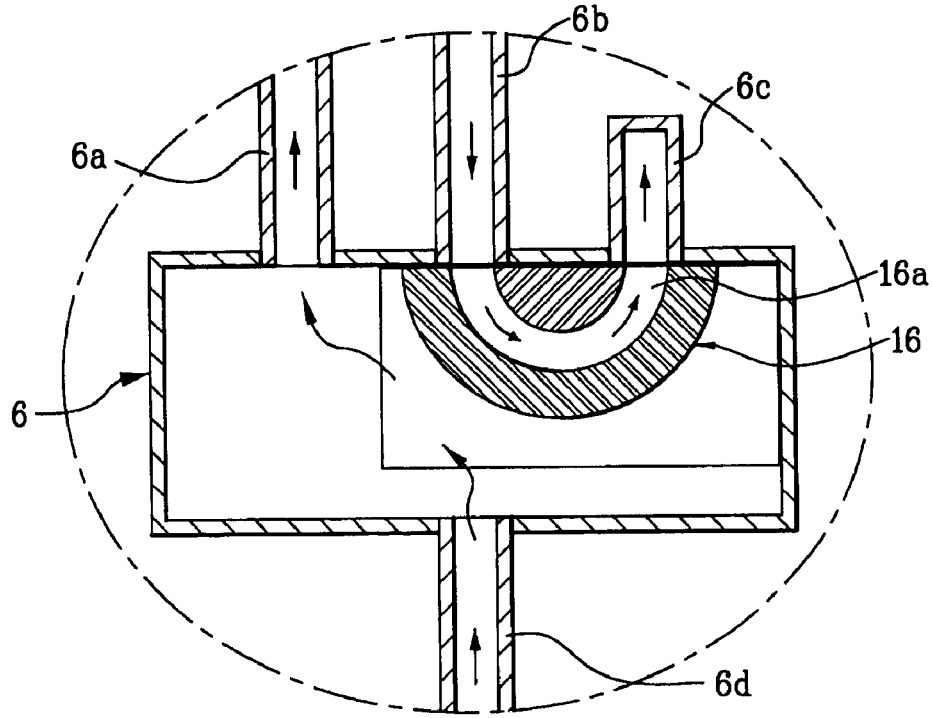
FIG. 4A is a schematic view showing that the four-way valve is switched so as to operate all or a majority of indoor units in a cooling mode.
Figure 4B:
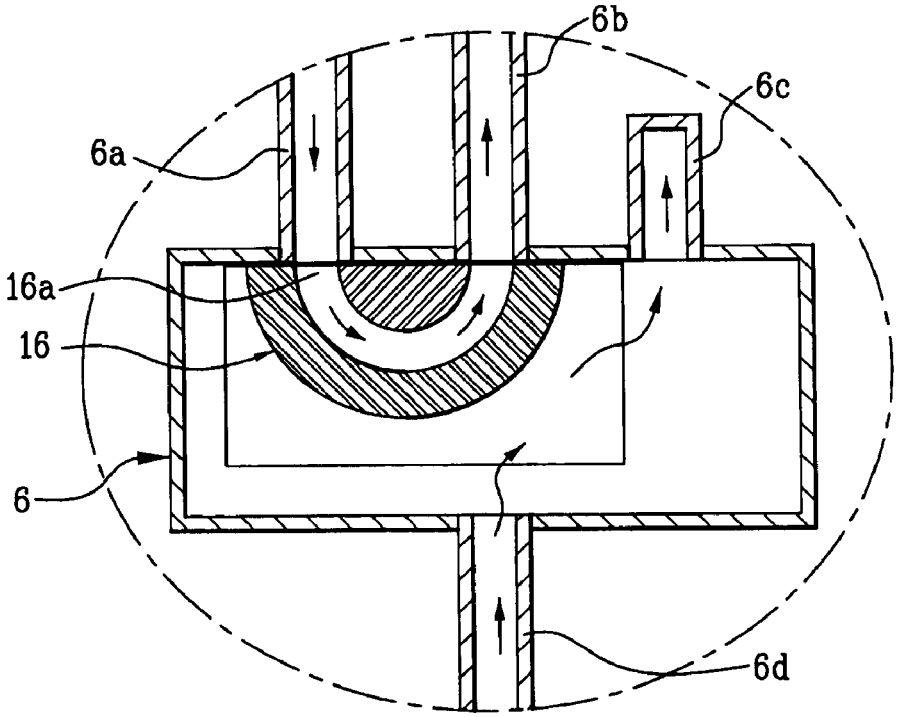
FIG. 4B is a schematic view showing that the four-way valve is switched so as to operate all or a majority of indoor units in a heating mode.

FIGS. 4A and 4B are schematic views showing an operation of when the four-way valve 6 is switched.

Referring to FIGS. 4A and 4B, the four-way valve has four outlets 6*a*, 6*b*, 6*c* and 6*d*. One outlet in the four-way valve communicates with one outlet to form two flow passages total. Inside the four-way valve, a pilot valve 16 is provided. The pilot valve 16 is moved to left or right sides to exchange the connection states of the respective outlets 6*a*, 6*b*, 6*c* and 6*d* by an electrical force generated by a switching signal. The four-way valve 6 is used to selectively change the flow direction of a refrigerant flowing through pipes connected thereto.

As shown in FIG. 1, the single outlet 6*c* of the four-way valve 6 is closed and the remaining outlets 6*a*, 6*b* and 6*d* are respectively connected with the outlet and inlet of the compressor 1 and the outer heat exchanger 2.

FIGS. 2A to 3B illustrate the operational states of a multi-air conditioner according to the operation condition.

Figure 2A:
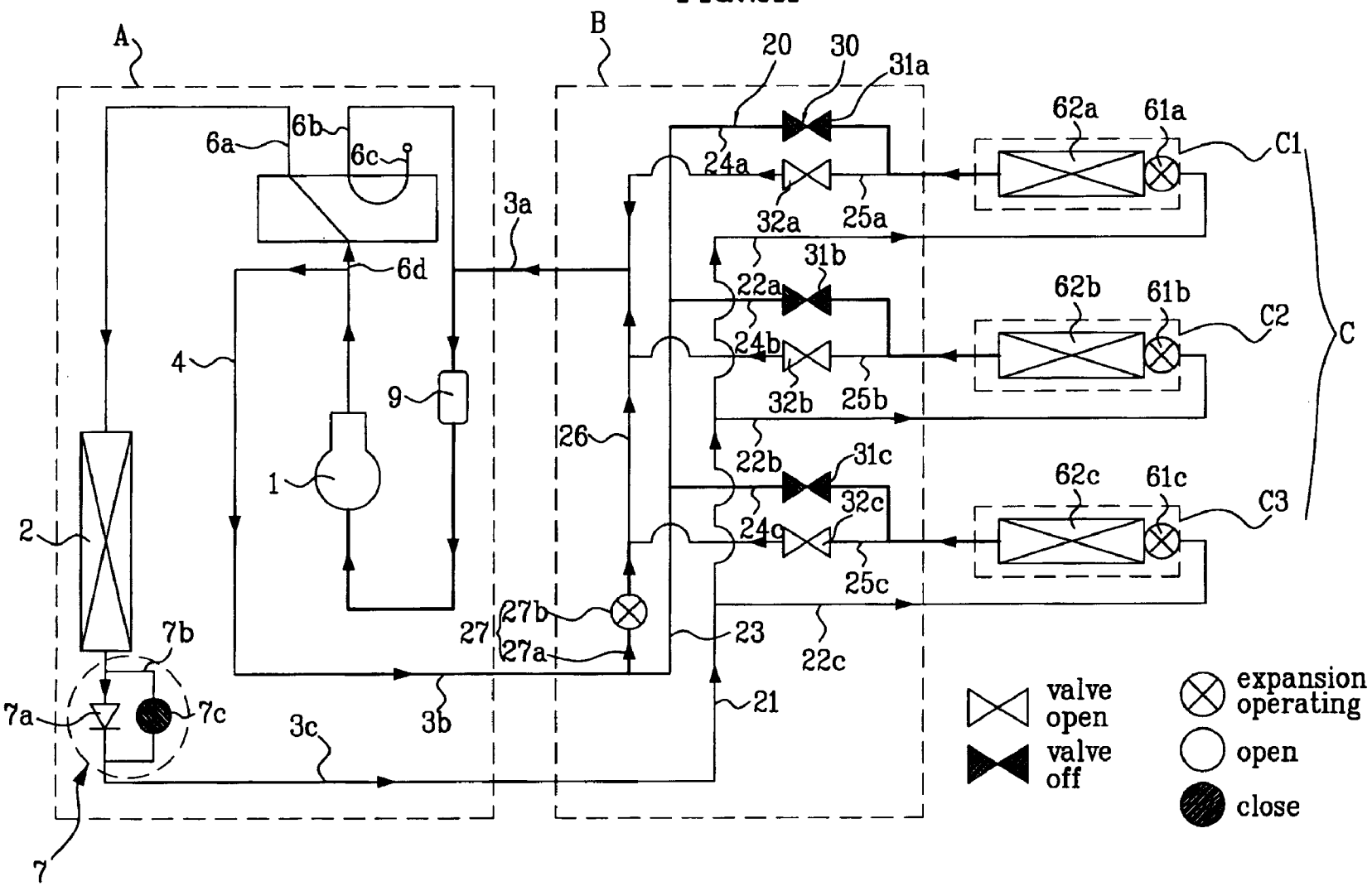
FIG. 2A is a view illustrating an operation state of FIG. 1 in case all indoor units operate in a cooling mode.

Referring to FIG. 2A, the four-way valve 6 is in a state, which connects the discharge outlet of the compressor 1 with the outer heat exchanger 2 and connects the inlet of the compressor 1 with the closed inlet 6*c*. In the meanwhile, referring to FIG. 3A, the four-way valve 6 is in a state which connects the discharge outlet of the compressor 1 with the closed inlet 6*c* and connects the inlet of the compressor with the outer heat exchanger 2. In other words, the four-way valve 6 is switched between two connection states of the pipes.

In the meanwhile, the selective expansion apparatus 7 is provided on the third connection pipe 3*c* to selectively expand the refrigerant according to the operation condition. The selective expansion apparatus 7 includes a check valve 7*a*, a parallel pipe 7*b* and a first electronic expansion valve 7*c*. The check valve 7*a* passes refrigerant selectively according to the flow direction. In other words, the check valve 7*a* passes the refrigerant flowing out of the outer heat exchanger 2 and cuts-off the refrigerant introduced into the outer heat exchanger 2. The parallel pipe 7*b* is branched respectively from a front end and a rear end of the check valve 7*a* and is provided in parallel with the check valve 7*a*. On the parallel pipe 7*b*, there is provided the first electronic expansion valve 7*c* for selectively expanding the refrigerant according to the operation condition. The electronic expansion valve used in the present invention is selectively controllable in operation/closed/opened states. In the operation state, the electronic expansion valve expands the refrigerant flowing therethrough.

Why the first electronic expansion valve 7*c* is separately provided on the parallel pipe 7*b* is to prevent a pressure loss in the third connection pipe 3*c* through which much amount of refrigerant flows. In other words, although the first electronic expansion valve 7*c* is opened, since the diameter of the pipe is too small to flow much amount of refrigerant, the separate parallel pipe 7*b* is provided to arrange the first electronic expansion valve 7*c* on the parallel pipe 7*b*. Accordingly, if the pressure loss is not so large when the electronic expansion valve, only a single electronic expansion valve can be provided on the third connection pipe 3*c* without needing to provide the separate parallel pipe 7*b*.

By controlling the four-way valve 6 and the selective expansion apparatus 6, the refrigerant flowing through the respective connection pipes 3*a*, 3*b* and 3*c* are maintained in a constant pressure and state regardless of the operation condition. In other words, the refrigerant flowing through the first pipe 3*a* is maintained in a low pressure/vapor phase state, the refrigerant flowing through the second connection pipe 3*b* is maintained in a high pressure/vapor phase state, and the refrigerant flowing through the third connection pipe 3*c* is maintained in a high pressure/liquid phase state.

The inventive multi-air conditioner is configured to cool or heat the plurality of indoor units (C). For this purpose, the discharging refrigerant flow of the compressor 1 is increased. Accordingly, when it is difficult to perform a proper compression operation by a single compressor, a plurality of compressors are preferably connected in parallel with each other to collect and discharge the refrigerants flowing out of the respective compressors, thereby performing an effective compression operation. Also, it is desirable that an accumulator 9 for buffering the absorbed refrigerant and separating the absorbed refrigerant into vapor and liquid is provided around the inlet of the compressor 1.

Next, a construction of the distributor (B) will be described in detail.

The distributor (B) guides the refrigerant introduced from the outdoor unit (A) to the respective indoor units (C). Since the pressure and phase of the refrigerants flowing through the respective connection pipes 3*a*, 3*b* and 3*c* connecting the outdoor unit (A) and the distributor (B) are constantly maintained, it is desirable that the pipes of the distributor (B) are also designed such that refrigerants having the same pressure and phase as those in the connection pipes 3*a*, 3*b* and 3*c* flow through.

As shown in FIG. 1, the distributor (B) is comprised of the guide pipe part 20 and the valve part 31. The guide pipe part 20 guides the refrigerant introduced from the outdoor unit (A) to the respective indoor units (C), and inversely guides the refrigerant heat-exchanged in the indoor units (C) to the outdoor unit (A). The valve part 31 controls a flow of the refrigerant in the guide pipe part 20 such that the refrigerant selectively flows into the plurality of indoor units (C) depending on the operation condition.

Herein, the guide pipe part 20 includes a first vapor pipe 26, first vapor divergent pipes 25, a second vapor pipe 23, a second vapor divergent pipes 24, a by-pass pipe 27*a*, and liquid divergent pipes 22.

As shown in FIG. 1, the first vapor pipe 26 is connected with the first connection pipe 3*a* to guide the low pressure/vapor-phase refrigerant. The first vapor divergent pipes 25 are branched from the first vapor pipe 26 to be connected with the respective indoor units (C). The second vapor pipe 23 is connected with the second connection pipe 3*b* to guide the high pressure/vapor-phase refrigerant. The second vapor divergent pipes 24 are branched from the second vapor pipe 23 to be connected with the respective indoor units (C). The by-pass pipe 27*a* connects the second connection pipe 3*b* and the first vapor pipe 26. The liquid pipe 21 is connected with the third connection pipe 3*c* to guide the high pressure/liquid phase refrigerant. And, the liquid divergent pipes 22 are branched from the liquid pipe 21 to be connected with the respective indoor units (C).

The valve part 30 is configured to include a second electronic expansion valve 27*b* and two-way valves 31 and 32.

As shown in FIG. 1, the second electronic expansion valve 27*b* is provided on the by-pass pipe 27*a* to expand the refrigerant staying in the second connection pipe 3*b* to a low pressure/vapor-phase refrigerant with controlling the opening degree of the by-pass pipe 27*a*. Under an operation condition for cooling all the indoor units (C), the second electronic expansion valve 27*b* prevents the high pressure/vapor-phase refrigerant staying in the second connection pipe 3*b* from being liquefied. If the liquefied refrigerant is immediately absorbed into the compressor 1, it may cause the compressor to be damaged. To this end, to guarantee a smooth operation of the compressor 1, the second electronic expansion valve 27*b* is provided.

The second two-way valves 31 and 32 are respectively provided on the first vapor divergent pipe 25 and the second vapor divergent pipes 24 and are controlled to be turned on of off depending on the operation condition.

In the meanwhile, it is desirable that the distributor (B) includes a plurality of distributors for easy installation of the indoor units.

Figure 5:
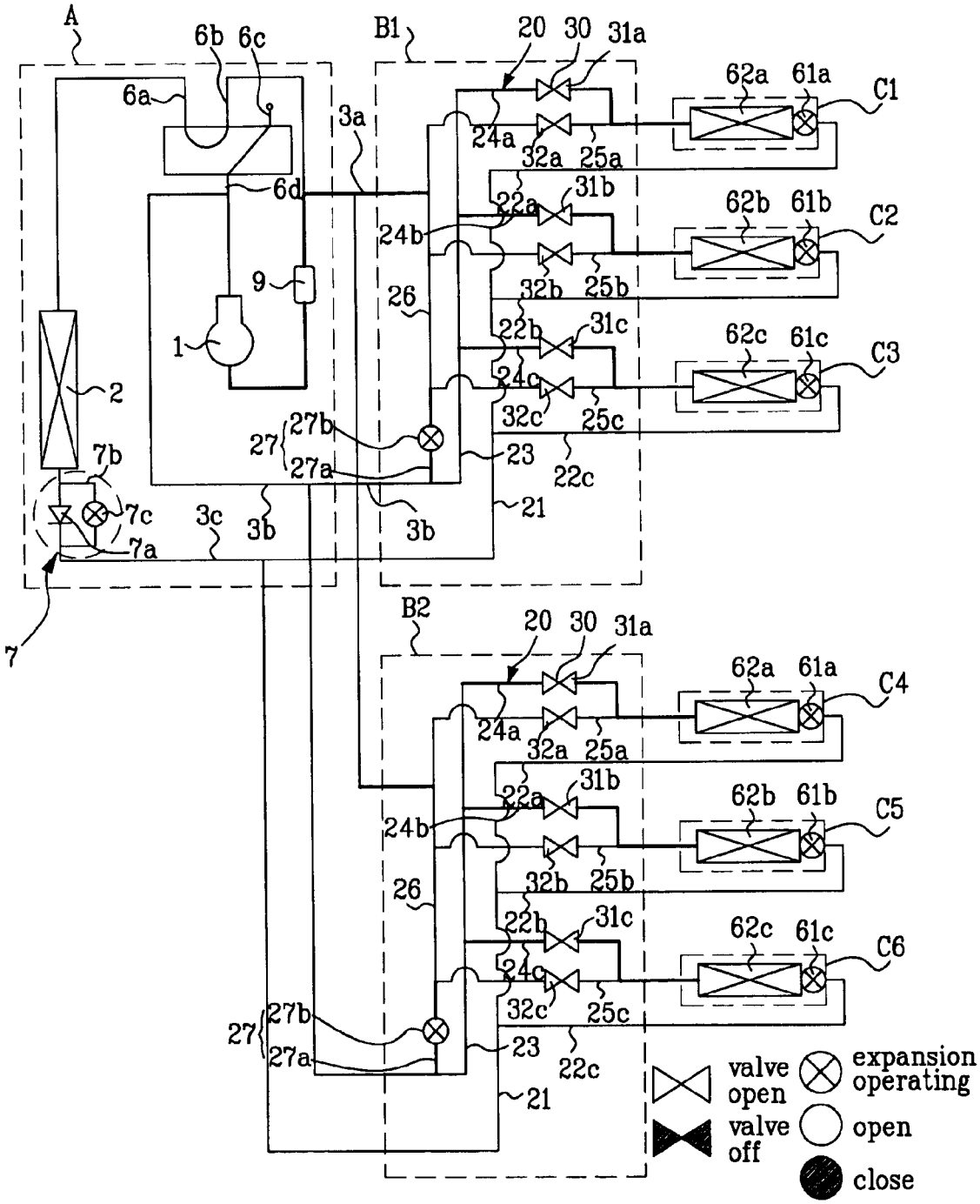
FIG. 5 is a schematic view of a multi-air conditioner provided with two distributors.

As shown in FIG. 5, in case the distributor (B) is comprised of two distributors (B1 and B2), the first connection pipe 3*a* is branched and connected with the first vapor pipe 26 of the second distributor (B2), the second connection pipe 3*b* is branched and connected with the second vapor pipe 25 of the second distributor (B2), and the third connection pipe 3*c* is branched and connected with the liquid pipe 21 of the second distributor (B2).

The respective connection pipes 3*a*, 3*b* and 3*c* through which constant pressure and phase refrigerants flow are respectively connected with the pipes 21, 23 and 26 of the first and second distributors (B1 and B2) through which the same pressure and phase refrigerants flow. Accordingly, a separate pressure control means is not required between the outdoor unit (A) and the multiple distributors (B1, B2), so that price per product can be reduced.

Each of the indoor units (C) connected with the distributor (B) has the following elements. As shown in FIG. 1, each indoor unit (C) is configured to include indoor heat exchanger 62, electronic expansion valve 61 and indoor fan (not shown).

The indoor heat exchanger 62 is provided between the first vapor divergent pipe 25 and the liquid divergent pipe 22. The electronic expansion valve 61 provided in the indoor unit is provided on the liquid divergent pipe and is controlled to be operated or closed depending on the operation condition. The indoor fan is provided to ventilate the indoor heat exchanger 62.

In the outdoor unit (A), the distributor (B) and the indoor units (C) constructed as above, the refrigerant flows to be matched with the operation condition of the air conditioner by properly controlling the four-way valve 6, the selective expansion apparatus 7, the valve part 30 and the electronic expansion valve 61 provided in the indoor heat exchanger 62.

First, the inventive multi-air conditioner switches the four-way valve to control the flow direction of the refrigerant depending on the operation condition.

In other words, in case the indoor units (C1, C2 and C3) are all operated in the cooling mode or the majority of the indoor units (C1, C2 and C3) are operated in the cooling mode while the rest of them is operated in the heating mode, the four-way valve 6 is switched to connect the discharge outlet of the compressor 1 with the outdoor heat exchanger 2 and to connect the inlet of the compressor 1 with the closed outlet 6*c*.

On the other hands, in case the indoor units (C1, C2 and C3) are all operated in the heating mode or the majority of the indoor units (C1, C2 and C3) are operated in the heating mode while the rest of them is operated in the cooling mode, the four-way valve 6 is switched to connect the discharge outlet of the compressor 1 with the closed outlet 6*c* and to connect the inlet of the compressor 1 with the outdoor heat exchanger 2.

Hereinafter, a description will be made for a construction and an operation thereof depending on an operation state of a whole system of a multi-air conditioner according to the present invention with reference to FIGS. 2A to 3B. Herein, it is assumed that the indoor unit (C) is comprised of three indoor units (C1, C2 and C3) for the convenience of description.

First, a description will be made for a case in which all the indoor units (C) are operated in a cooling mode.

As shown in FIG. 2A, most of a high pressure/vapor phase refrigerant discharged from the compressor 1 is introduced into the outdoor heat exchanger 2 by a switching operation of the four-way valve 6 to be condensed. The condensed refrigerant passes through the check valve 7*a* of the selective expansion apparatus 7, and is introduced into a vapor pipe 21 of the distributor (B) via the third connection pipe 3*c*. Here, the first electronic expansion valve 7*c* provided in the selective expansion apparatus 7 is closed. Next, after the introduced refrigerant is branched into each of the liquid divergent pipes 22, the branched refrigerant passes through the indoor electronic expansion valve 61 to be expanded and also passes through each of the indoor heat exchanger 62 to be evaporated, thereby cooling the respective rooms. Since the two-way valve 31 of the second vapor divergent pipe 24 is closed, the evaporated refrigerant passes through each of the first vapor divergent pipe 25 and is introduced into the first vapor pipe 26.

On the other hand, the rest of the refrigerant discharged from the compressor 1 flows along the second connection pipe 3*b* branched from a pipe for connecting the discharge outlet of the compressor 1 and the four-way valve 6. The second connection pipe 3*b* is connected with the second vapor pipe 23 and the second vapor divergent pipe 25. However, since the two-way valve 32 provided on the second vapor divergent pipe 25 is closed, the refrigerant is introduced into the bypass pipe 27*a*. The bypass pipe 27*a* is provided with the second electronic expansion valve 27*b* for preventing the refrigerant from being liquefied. The low pressure/vapor-phase refrigerant is expanded due to an operation of the second electronic expansion valve 27*b* and is introduced into the first vapor pipe 26. That is, the refrigerant passing through the bypass pipe 27*a* is mixed with the refrigerant passing through the indoor heat exchanger 62 in the first vapor pipe 26 and flows through the first connection pipe 3*a* to the outdoor unit (A). At this time, a portion of the refrigerant is introduced into the four-way valve 6*a* having a closed outlet, but it no longer flows.

Second, a description will be made for a case in which a majority (C1, C2) of indoor units (C) are operated in the cooling mode, and the rest of the indoor units (C1, C2 and C3) is operated in a heating mode.

Figure 2B:
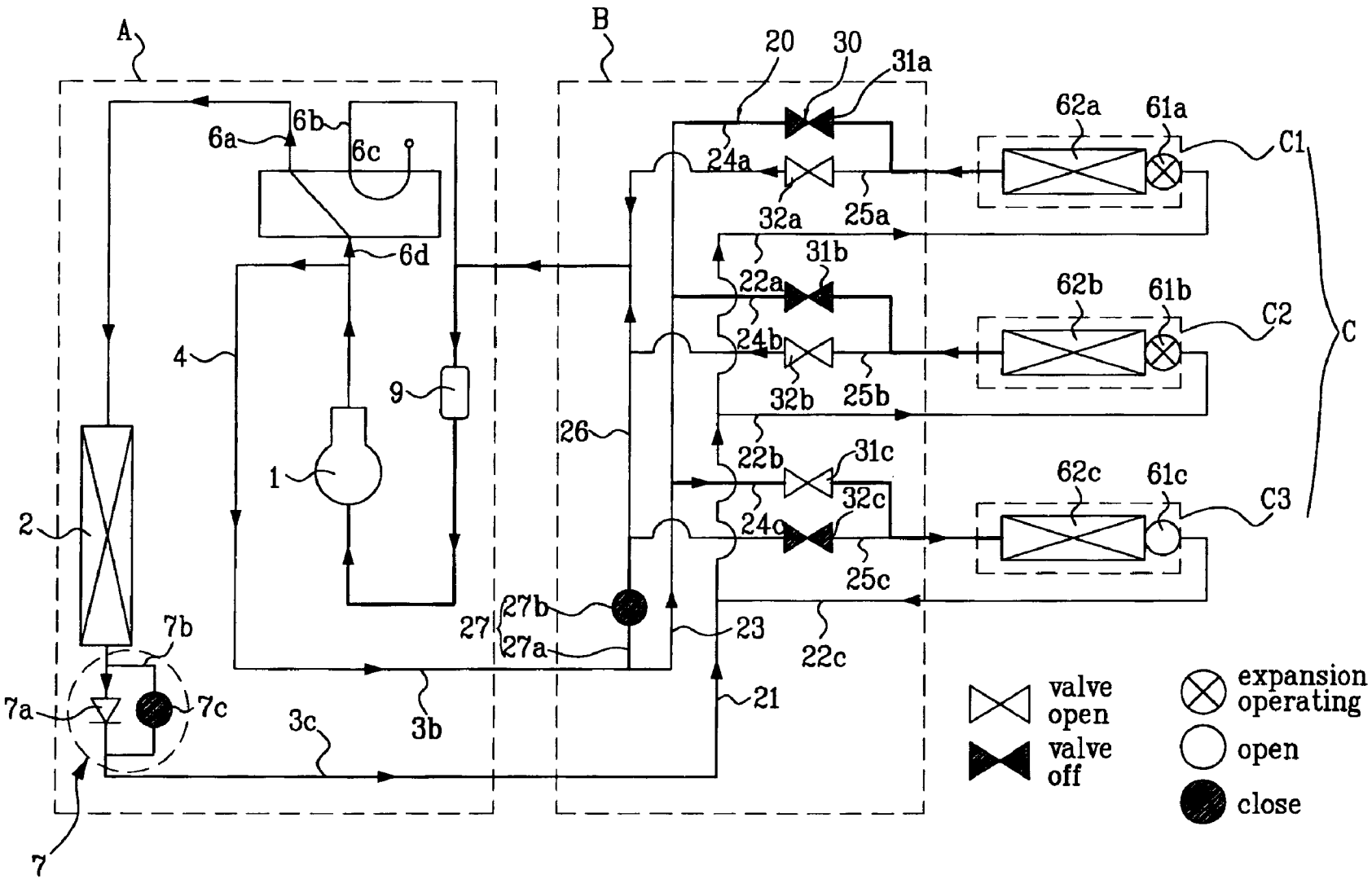
FIG. 2B is a view illustrating an operation state of FIG. 1 in case a majority of indoor units operate in a cooling mode while the rest of the indoor units operate in a heating mode.

As shown in FIG. 2B, a portion of a high pressure/vapor phase refrigerant discharged from the compressor 1 is introduced into the second vapor pipe 23 of the distributor (B) through the second connection pipe 4. On the other hand, the rest thereof is introduced into the outdoor heat exchanger 2 by a switching operation of the four-way valve 6 and is condensed. The condensed refrigerant passes through the check valve 7*a* and is introduced into a liquid pipe 21 of the distributor (B) via the third connection pipe 3*c*. Here, the first electronic expansion valve 7*c* provided in the selective expansion apparatus 7 is in a closed state.

Next, after the introduced refrigerant is respectively branched into the first and second liquid divergent pipes 22*a* and 22*b* connected with the indoor units (C1, C2) needing to operate in the cooling mode, the branched refrigerant passes through the indoor electronic expansion valves 61*a* and 61*b* to be expanded and passes through each indoor heat exchanger 62*a* and 62*b* to be evaporated, thereby cooling the rooms.

Meanwhile, after the refrigerant introduced into the second vapor pipe 23 is introduced into the second vapor divergent pipe 24*c* connected with the indoor unit (C3) needing to operate in the heating mode, the introduced refrigerant passes through the indoor heat exchanger 62*c* to be condensed, so that the rooms operate in the heating mode.

Next, the condensed refrigerant passes through the opened electronic expansion valve 61*c* and a liquid pipe 22*c* to be introduced into the liquid pipe 21. As a result, the refrigerant separated in the compressor 1 is combined in the liquid pipe 21 and is branched into each of the liquid pipes 22*a* and 22*b* connected with the indoor unit (C) needing to operate in the cooling mode, to be evaporated in each of the outdoor heat exchangers 62*a* and 62*b*, so that the indoor unit (C) is operated in the cooling mode.

Next, since the evaporated refrigerant is cut-off by the two-way valves 31*a* and 31*b* of the second vapor divergent pipe 24, it passes through the first vapor divergent pipes 25*a* and 25*b* to be introduced into the first vapor pipe 26, and passes through the first connection pipe 3*a* to be absorbed in the compressor 1.

Third, a description will be made for the case operating all indoor units (C) in the heating mode.

Figure 3A:
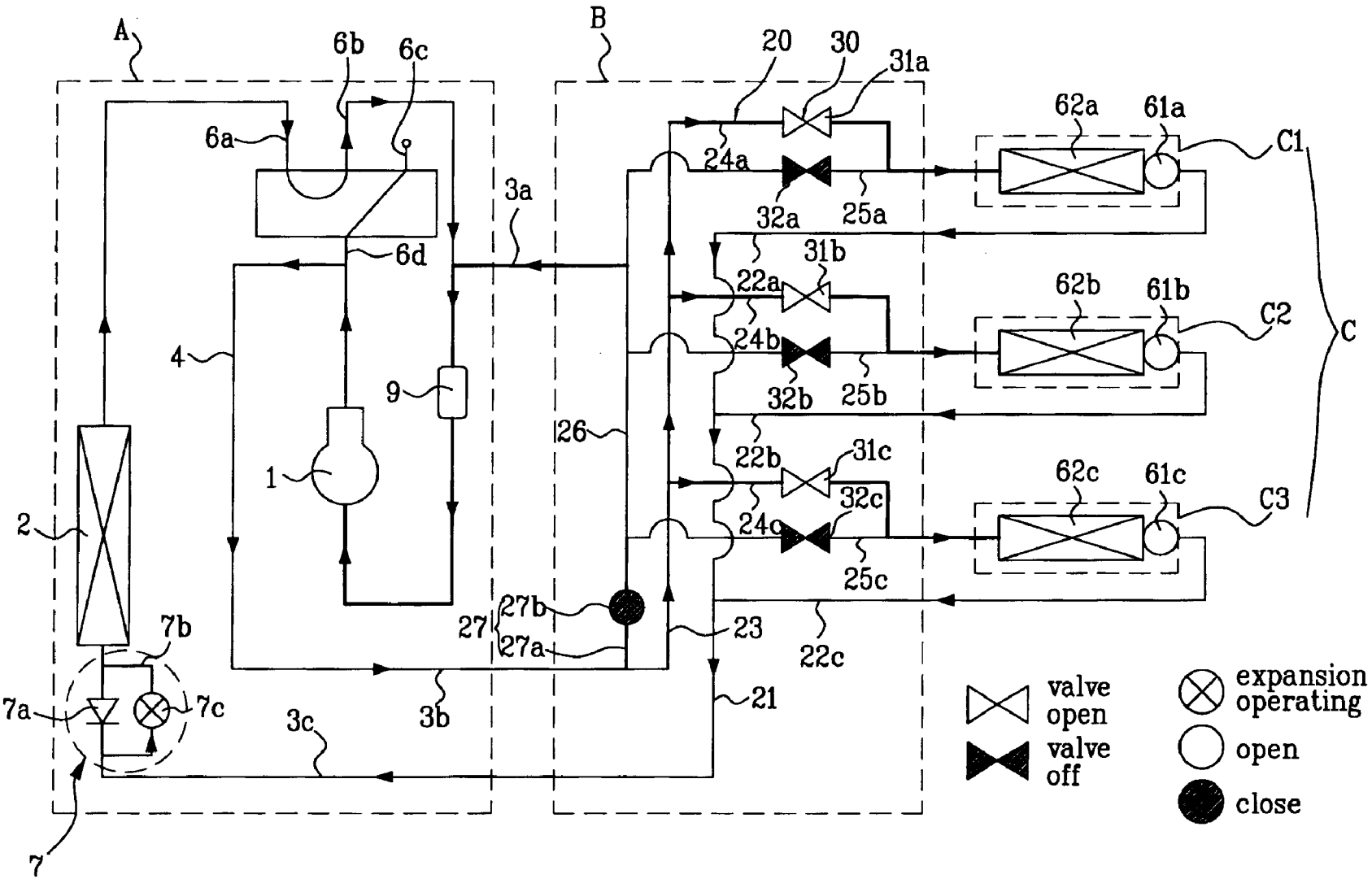
FIG. 3A is a view of illustrating an operation state of FIG. 1 in case all the indoor units operate in a heating mode.

As shown in FIG. 3A, the high pressure/vapor phase refrigerant discharged from the compressor 1 passes through the second connection pipe 3*b*, not via the outdoor heat exchanger 2, by the switching operation of the four-way valve 6 to be introduced into the second vapor pipe 23 of the distributor (B) in the high pressure/vapor phase state. After the introduced refrigerant is branched into the second vapor divergent pipe 24, it passes through each indoor heat exchanger 62 to be condensed, so that the rooms operate in the heating mode.

After that, the condensed refrigerant passes through the opened electronic expansion valve 61, and collected into the liquid pipe 21 through each of the liquid divergent pipes 22. Next, the collected refrigerant flows through the third connection pipe 3, and then due to close of the check valve 7*a*, the refrigerant passes through the first electronic expansion valve 7*c* to be expanded and passes through the outdoor heat exchanger 22 to be evaporated. Herein, the first electronic expansion valve 7*c* provided in the selective expansion apparatus 7 is operated. The evaporated refrigerant is absorbed in the compressor 1 by the switching operation of the four-way valve 6.

Fourth, a description will be made for a case in which the majority (C1, C2) of indoor units (C) are operated in the heating mode while the rest (C3) thereof is operated in the cooling mode.

Figure 3B:
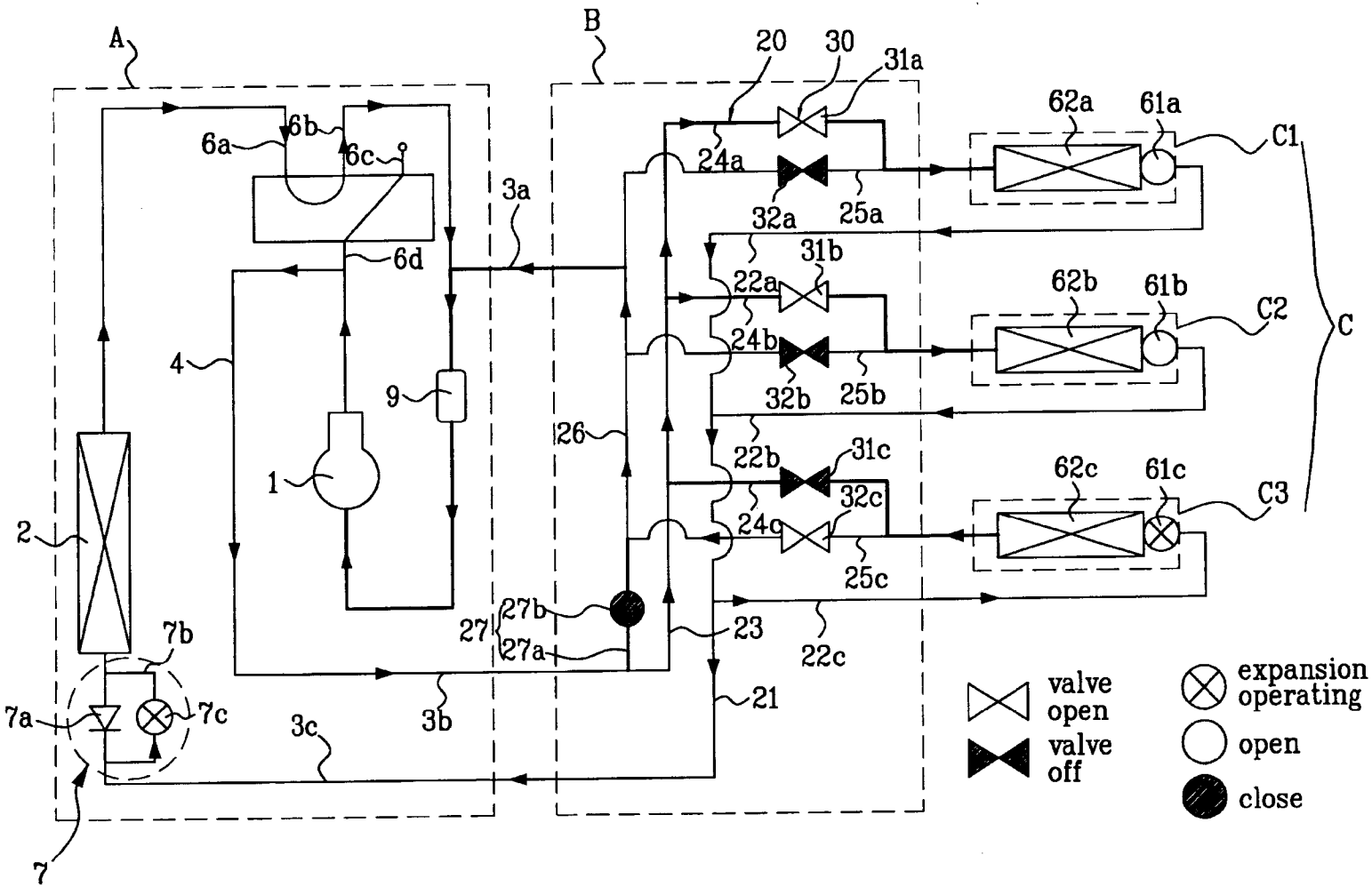
FIG. 3B is a view of illustrating an operation state of FIG. 1 in case a majority of indoor units operates in a heating mode while the rest of the indoor units operate in a cooling mode.

As shown in FIG. 3B, the high pressure/vapor phase refrigerant discharged from the compressor 1 passes through the second connection pipe 3*b* by the switching operation of the four-way valve 6 to be introduced into the second vapor pipe 23 of the distributor (B).

The introduced refrigerant is branched into each of the second vapor divergent pipes 24*a* and 24*b* connected with the indoor units 62*a* and 62*b* needing to operate in the heating mode, and passes through each of the indoor heat exchangers 62*a* and 62*b* to be condensed, so that the rooms operate in the heating mode. The condensed refrigerant passes through the opened electronic expansion valves 61*a* and 61*b*, and flows through the liquid divergent pipes 22*a* and 22*b* to be converged into the liquid pipe 21.

At this time, most of the condensed refrigerant flows through the liquid pipe 21 and is introduced into the third connection pipe 3*c*, and due to the close of the check valve 7*a*, the introduced refrigerant passes through the first electronic expansion valve 7*c* to be expanded. Herein, the first electronic expansion valve 7*c* provided in the selective expansion apparatus 7 is operated. After that, the expanded refrigerant passes through the outdoor heat exchanger 2 and is introduced into the compressor 1 by the switching operation of the four-way valve 6.

On the other hand, the rest of the condensed refrigerant is introduced into the liquid divergent pipe 22*c* connected with the indoor units (C1, C2) needing to be operated in the heating mode, and passes through the electronic expansion valve 61*c* to be expanded. After that, the expanded refrigerant passes through the indoor heat exchanger 62*c* to be evaporated, so that the rooms operate in the cooling mode. Next, due to the close of the two-way valve 31*c* of the second vapor divergent pipe 24*c*, the evaporated refrigerant flows through the first vapor divergent pipe 24*c* and is introduced into the first vapor pipe 26. The introduced refrigerant is absorbed in the compressor 1 through the first connection pipe 3*a*.

As described above, the multi-air conditioner according to the present invention can achieve an optimal adaptation for environments of respective rooms. That is, the majority of the indoor units can be operated in the cooling mode while the rest can be operated in the heating mode, as well as all the indoor units can be operated in the cooling mode or the heating mode.

Further, since the number of the connection pipes constituting the pipe construction of the outdoor unit is simplified to three, and a constant pressure and a constant phase of refrigerant flows through each connection pipe regardless of an operation condition, easy design of pipe diameter can be accomplished. Furthermore, the pipes of the distributor respectively connected to the connection pipes can be also specified to allow the same pressure and phase refrigerant as those of each connection pipe to flow therethrough so that the pipe diameter of the distributor can be prevented from being excessively designed and a flow of the refrigerant can be prevented from being irregularly inputted.

As mentioned above, the multi-air conditioner according to the present invention provides the following advantages.

First, an optimal adaptation can be achieved for environments of respective rooms. That is, all the rooms can be cooled, or a part of the rooms can be cooled at the same time. Further, all the rooms can be heated or a part of the rooms can be cooled at the same time.

Second, as the number of the connection pipe for connecting the outdoor unit with the distributor is simplified to three, a design of the distributor can be simplified and a manufacture process can be simplified.

Third, since the constant pressure and phase of refrigerant flows through each connection pipe regardless of the operation condition, the easy design of the pipe diameter can be achieved and the irregular flow amount of the refrigerant can be prevented. Accordingly, the pipes of the distributor can be also specified to allow the same pressure and phase of refrigerant as those of the connection pipe to flow therethrough.

Fourth, since the by-pass pipe having the second electronic expansion valve is provided, in case all the rooms are operated in the cooling mode, the high pressure/gas phase refrigerant staying in the second connection pipe can be prevented from being liquefied so that the vapor-phase refrigerant introduced into the first vapor pipe is prevented from being short.

Fifth, the plurality of the distributors can be provided, and an easier installation of each indoor unit can be achieved.

Sixth, the plurality of the distributors can be provided so that even when the distributor is connected with the outdoor unit, since a pressure control unit does not additionally need, a construction simplification and a low price of the product can be accomplished.

Seventh, not four-way valve, but a low priced two-way valve is provided to control the distributor so that a cost of the product can be lowered.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A multi-air conditioner comprising:

an outdoor unit installed at an outdoor location, and having therein a compressor and an outdoor heat exchanger;

a plurality of indoor units respectively installed at indoor rooms, each of the indoor units having therein an electronic expansion valve and an indoor heat exchanger;

a distributor provided between the outdoor unit and the plurality of indoor units, for selectively guiding a refrigerant introduced from the outdoor unit to the plurality of indoor units according to an operation condition;

a four-way valve provided on a discharge side of the compressor, for selectively switching a flow direction of the refrigerant flowing through the outdoor heat exchanger;

a first connection pipe branched from a pipe connecting an absorbing side of the compressor with the four-way valve, for connecting the distributor to guide the refrigerant;

a second connection pipe branched from a pipe connecting the discharge side of the compressor with the four-way valve, for connecting the distributor to guide the refrigerant;

a third connection pipe for connecting the outdoor heat exchanger with the distributor to guide the refrigerant; and a selective expansion apparatus provided on the third connection pipe and including a heating electronic expansion unit for selectively expanding the refrigerant.

2. The multi-air conditioner of claim 1, wherein the four-way valve comprises three outlets respectively connected with the discharge outlet/the absorbing inlet of the compressor, and the outdoor heat exchanger, and one outlet, which is closed.

3. The multi-air conditioner of claim 2, wherein the four-way valve selectively switches between a first connection state in which the discharge outlet of the compressor is connected with the outdoor heat exchanger and the absorbing inlet of the compressor is connected with the closed outlet of the four-way valve, and a second connection state in which the discharge outlet of the compressor is connected with the closed inlet of the four-way valve and the absorbing inlet of the compressor is connected with the outdoor heat exchanger.

4. The multi-air conditioner of claim 1, wherein the selective expansion apparatus comprises:

a check valve for passing the refrigerant flowing out of the outdoor heat exchanger and cutting-off the refrigerant introduced into the outdoor heat exchanger;

a parallel pipe respectively branched from a front end and a rear end of the check valve and provided in parallel with the check valve; and a first electronic expansion valve provided on the parallel pipe.

5. The multi-air conditioner of claim 4, wherein the distributor comprises:

a guide pipe part for guiding the refrigerant introduced from the outdoor unit to the respective indoor units through the second connection pipe or the third connection pipe, and guiding the refrigerant heat-exchanged in the respective indoor units to the outdoor unit through the first connection pipe or the third connection pipe; and a valve part for controlling a flow of the refrigerant in the guide pipe part such that the refrigerant is selectively introduced into the respective indoor unit according to the operation condition.

6. The multi-air conditioner of claim 5, wherein the guide pipe part comprises:

a first vapor pipe connected with the first connection pipe, for guiding the low pressure/vapor-phase refrigerant;

first vapor divergent pipes branched from the first vapor pipe and connected to the respective indoor units;

a second vapor pipe connected with the second connection pipe, for guiding the high pressure/vapor-phase refrigerant;

second vapor divergent pipes branched from the second vapor pipe and connected to the respective indoor units;

a by-pass pipe connecting the second connection pipe with the first vapor pipe;

a liquid pipe connected with the third connection pipe, for guiding the high pressure/liquid-phase refrigerant; and liquid divergent pipes branched from the liquid pipe and connected to the respective indoor units.

7. The multi-air conditioner of claim 6, wherein the valve part comprises:

a second electronic expansion valve for preventing the refrigerant supplied into the by-pass pipe from being liquefied; and a two-way valve provided on each of the first vapor divergent pipes and the second vapor divergent pipes, and turned on or off according to the operation condition.

8. The multi-air conditioner of claim 7, wherein in case the indoor units all operate in the cooling mode or in case the majority of indoor units operate in the cooling mode while the rest operate in the heating mode, the four-way valve is switched to connect the outlet of the compressor with the outdoor heat exchanger and to connect the inlet of the compressor with the closed inlet of the four-way valve.

9. The multi-air conditioner of claim 8, wherein in case the indoor units all operate in the cooling mode, the first electronic expansion valve is closed and the second electronic expansion valve is operated, the electronic expansion valves connected with all the indoor units is operated, the two-way valves provided on the first vapor divergent pipe are all closed, and the two-way valves provided on the second vapor divergent pipe are all closed.

10. The multi-air conditioner of claim 8, wherein in case the majority of indoor units operate in the cooling mode while the rest operates in the heating mode, the first and second electronic expansion valves are closed, in case of the indoor units operating in the cooling mode, the electronic expansion valves connected to the indoor heat exchangers are operated, the two-way valves provided on the first vapor divergent pipes are opened, and the two-way valves provided on the second vapor divergent pipes are closed, and in case of the indoor units operating in the heating mode, the electronic expansion valves connected to the indoor heat exchangers are opened, and the two-way valves provided on the first vapor divergent pipes are closed, and the two-way valves provided on the second vapor divergent pipes are opened.

11. The multi-air conditioner of claim 7, wherein in case the indoor units all operate in the heating mode, or in case the majority of indoor units operate in the heating mode while the rest operates in the cooling mode, the four-way valves are switched to connect the outlet of the compressor with the closed inlet of the four-way valve and to connect the inlet of the compressor with the outdoor heat exchanger.

12. The multi-air conditioner of claim 11, wherein in case the indoor units all operate in the heating mode, the first electronic expansion valve is operated, the second electronic expansion valve is closed, the electronic expansion valves connected with all the indoor units are opened, the two-way valves provided on the first vapor divergent pipe are all closed, and the two-way valves provided on the second vapor divergent pipe are all opened.

13. The multi-air conditioner of claim 11, wherein in case the majority of indoor units operate in the heating mode while the rest operates in the cooling mode, the first electronic expansion valve is operated and the second electronic expansion valve is closed, in case of the indoor units operating in the heating mode, the electronic expansion valves connected to the indoor heat exchangers are opened, the two-way valves provided on the first vapor divergent pipes are closed, and the two-way valves provided on the second vapor divergent pipes are opened, and in case of the indoor units operating in the cooling mode, the electronic expansion valves connected to the indoor heat exchangers are operated, the two-way valves provided on the first vapor divergent pipes are opened, and the two-way valves provided on the second vapor divergent pipes are closed.

14. The multi-air conditioner of claim 6, wherein the electronic expansion valve provided on each of the indoor units is provided on the liquid divergent pipe.

15. The multi-air conditioner of claim 6, wherein the distributor comprises a plurality of distributors provided for easy installation of each of the indoor units.

16. The multi-air conditioner of claim 15, wherein the first vapor pipe of each of the distributors is connected with the first connection pipe of the outdoor unit, the second vapor pipe of each of the distributors is connected with the second connection pipe of the outdoor unit, and the liquid pipe of each of the distributors is connected with the third connection pipe.

17. The multi-air conditioner of claim 1, wherein the refrigerant flowing through the first connection pipe is maintained in a state of a low pressure/vapor phase, the refrigerant flowing through the second connection pipe is maintained in a state of a high pressure/vapor phase, and the refrigerant flowing through the third connection pipe is maintained in a state of a high pressure/liquid phase.

18. The multi-air conditioner of claim 1, wherein the compressor comprises a plurality of compressors connected in parallel with each other, for performing compression operation.

19. The multi-air conditioner of claim 1, wherein the absorbing inlet of the compressor further comprises an accumulator.

20. An operation method of a multi-air conditioner, the method comprising the steps of:

in case indoor units all operate in a cooling mode, or in case a majority of indoor units operate in the cooling mode while the rest operate in a heating mode, switching a four-way valve such that a refrigerant discharged from a compressor passes through an outdoor heat exchanger; and closing a first electronic expansion valve provided on a selective expansion apparatus to guide the refrigerant condensed in the outdoor heat exchanger to a distributor, and in case the indoor units all operate in the heating mode, or in case the majority of indoor units operate in the heating mode while the rest operate in the cooling mode, switching the four-way valve such that refrigerant discharged from the compressor is introduced into the distributor; and operating the first electronic expansion valve provided on the selective expansion apparatus to expand the refrigerant introduced into the outdoor heat exchanger from the distributor.

* * * * *